United States Patent [19]

Hegg

[11] 4,333,390

[45] Jun. 8, 1982

[54] BALANCED PIVOTED VANE VALVE

[75] Inventor: Billy S. Hegg, South Bend, Ind.

[73] Assignee: The Bendix Corporation, Southfield, Mich.

[21] Appl. No.: 126,159

[22] Filed: Feb. 29, 1980

[51] Int. Cl.[3] ..... F15B 13/04

[52] U.S. Cl. ..... 91/467; 137/625.2; 137/625.44

[58] Field of Search ..... 91/467; 137/625.2, 625.44, 137/625.45, 625.25

[56] References Cited

U.S. PATENT DOCUMENTS

| | | | |
|---|---|---|---|
| 197,076 | 11/1877 | Aitken | 137/625.25 |
| 198,779 | 1/1878 | Rice | 137/625.25 |
| 2,404,281 | 7/1946 | Eaton | 91/465 X |
| 2,986,165 | 5/1961 | Hogan | 137/625.25 |
| 3,200,844 | 8/1965 | Jackson | 137/625.2 |
| 4,046,061 | 9/1977 | Stokes | 137/625.45 |

*Primary Examiner*—Irwin C. Cohen
*Attorney, Agent, or Firm*—Leo H. McCormick, Jr.; Ken C. Decker

[57] ABSTRACT

A control member for supplying a pressure responsive device with pressurized fluid in response to an input signal. The control member has a housing with a chamber therein. The chamber is connected to a source of pressurized fluid through an entrance port, to a pressure responsive device through first and second operational ports and to the surrounding environment through an exit port. A lever located in the chamber has a bore therein that is connected to the entrance port to define a flow path for the pressurized fluid through the chamber. Depending on a desired operation of the pressure responsive device, an input signal is applied to the lever to bring the bore into communication with one of the first and second operational ports to allow pressurized fluid to flow to the pressure responsive device while the other operational port is connected to the surrounding environment through the chamber. When the input signal terminates, a pair of springs move the lever to a null position intermediate the first and second operational port to terminate the pressurized fluid communication to the pressure responsive device.

8 Claims, 3 Drawing Figures

BALANCED PIVOTED VANE VALVE

BACKGROUND OF THE INVENTION

This invention relates to a valve member in a two-stage servo assembly that controls the operation of an output motor in response to an input force.

Two-stage servo valve systems have been used to provide fluid to an output device such as a piston, where the piston movement controls the operation of a motor. Such a two-stage servo valve is disclosed in U.S. Pat. No. 3,745,883 which has a first spool valve connected to a second spool valve. The first spool is connected to an input member and the second spool is connected to the piston. The first spool moves in response to the input member and allows pressurized fluid to flow to the second spool valve. The pressurized fluid acts on the second spool valve and overcomes the force of a centering spring to thereafter allow pressurized fluid to move the piston. Movement of the piston provides an operational force for operating flaps, elevators, bleed valves, etc. on an aircraft. Unfortunately, the spool valves in such two-stage devices often times stick due to differences in expansional characteristics with the housing caused by temperature changes. Thus, for a smooth operating valve, the pressurized fluid must be maintained at a substantially constant temperature level.

The sticking problem could be avoided through the use of floating discs such as disclosed in U.S. Pat. No. 3,402,737. However, the response time in moving the first and second stage disc from a null position to an actuating position has not been acceptable for most devices in aircraft due to rapid changes in operating conditions.

SUMMARY OF THE INVENTION

The invention disclosed herein provides a control member having a balanced valve, which is substantially uneffected by temperature changes, through which pressurized fluid is supplied to a pressure responsive device.

The control member has a housing with a chamber therein. The housing has an entrance port for connecting a source of pressurized fluid to the chamber, first and second operational ports for connecting the chamber to the pressure responsive device, and an exit port for connecting the chamber to the surrounding environment.

The balanced valve includes a lever with a cylindrical member located on a first end thereof. The cylindrical member has a bore that extends from a first face to a second face. A low friction pin extends through the lever to locate the first face adjacent the entrance port and between the first and second operational ports. Pressurized fluid which is communicated through the entrance port into the bore acts on the cylindrical member to establish a balanced force condition therein. An input signal applied to a second end of the lever causes the lever to pivot on the pin and move the cylindrical member toward one of the first and second operational ports while at the same time move away from the other of the first and second operational ports. As the cylindrical member moves, the bore is brought into alignment with the selected operational port to allow pressurized fluid to operate the pressure responsive device and at the same time, the other operational port is connected to the surrounding environment by way of the chamber and exit port. The input signal terminates when the pressure responsive device meets an operational demand. Thereafter, first and second springs move the lever to a null position to reestablish the balanced force condition in the bore.

It is an object of this invention to provide a control member with a balanced valve through which pressurized fluid is supplied to a selected operational port in response to an input signal.

It is an advantageous effect of this invention to reduce the effect of rapid temperature changes on the movement of a control valve in a housing.

It is another advantageous effect of this invention to provide a two-stage servo valve with a first stage control having a balanced valve therein to reduce the dynamic forces associated with the flow of pressurized fluid to a second stage control.

These and other features and advantages should become apparent from reading this specification while viewing the drawing.

DETAILED DESCRIPTION OF THE INVENTION

Figure 1:
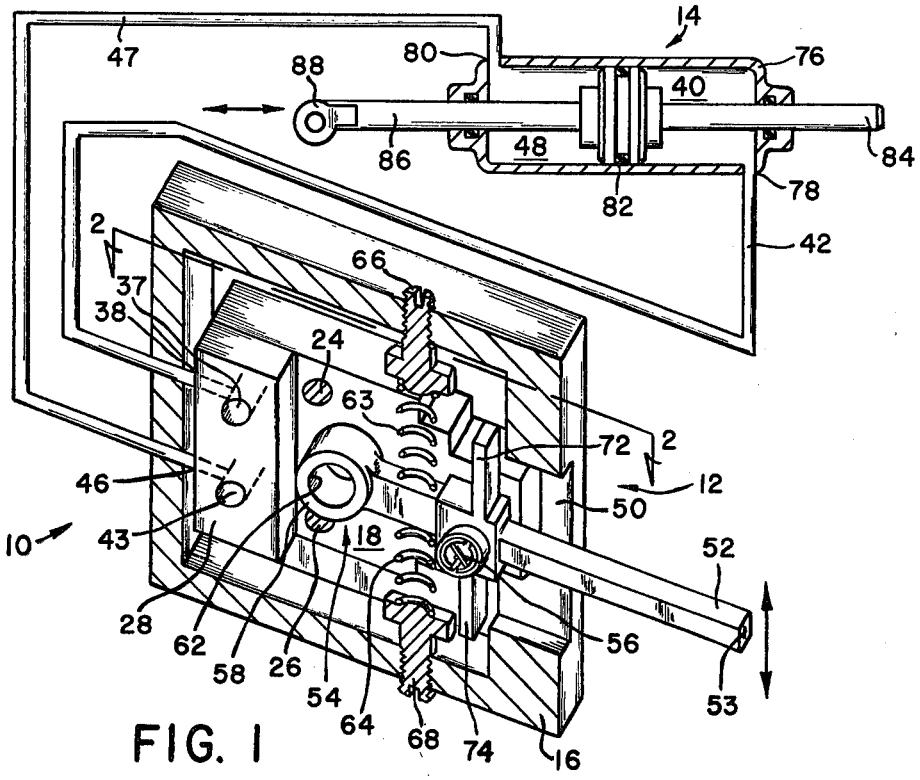
FIG. 1 is a schematic illustration of a servo valve mechanism with a sectional view of a first control made according to the principles of this invention, through which pressurized fluid is supplied to operate a piston in a second control.

The servo valve mechanism 10 shown in FIG. 1 has a first control 12 and a second control 14. The first control 12 receives an input signal and correspondingly supplies the second control 14 with an input signal to operate a mechanism.

In U.S. patent application No. 91,637 filed Nov. 5, 1979 and incorporated herein by reference, the first control 12 is connected to a spool valve control for supplying pressurized air to a motor. The operation of the motor is communicated to a central control apparatus and when it matches the input signal, the pressurized fluid supplied to the motor is terminated.

Figure 2:
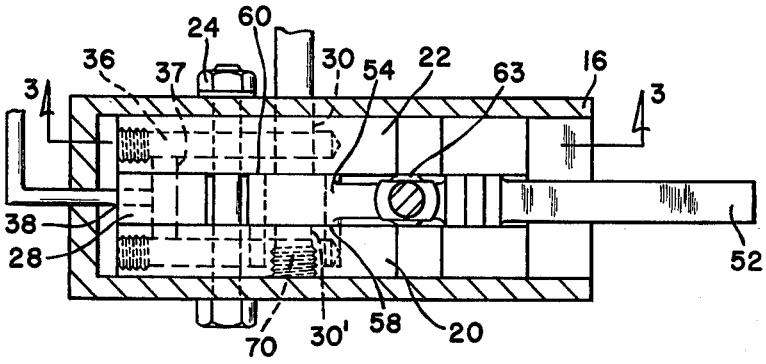
FIG. 2 is a top view of the first control shown in FIG. 1.

In more particular detail, the first control 12 has a housing 16 with a chamber 18 therein. The housing 16 has first and second sidewalls 20 and 22 attached to each other by fasteners 24 and 26. As shown in FIGS. 1 and 2, the sidewalls 20 and 22 are separated from each other by spacer 28.

Each of the sidewalls 20 and 22 are identical and thus only sidewall 22 is hereafter described in detail. When necessary for understanding this invention the components in sidewall 20 are identified by the number identification of wall 22 plus prime (').

Figure 3:
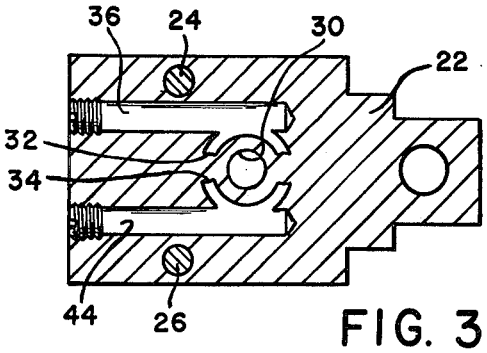
FIG. 3 is a sectional view taken along line 3—3 of FIG. 2 showing the operational passages through which pressurized fluid is supplied to the piston.

Sidewall 22, as shown in FIGS. 2 and 3, has a central opening or bore 30 that extends therethrough. A first operational port 32 is concentrically located on one side of the central bore 30 and a second operational port 34 is concentrically located on the other side thereof. The first operational port 32 is connected to a first exit port 38 located in the spacer 28 by a passage 36 in sidewall 22 and passage 37 in spacer 28. This first exit port 38 is connected to a first chamber 40 in the second control 14 by conduit 42.

Similarly, the second operational port 34 is connected to a second exit port 46 in the spacer 28 by a passage 44 in sidewall 22 and passage 43 in spacer 28. This second exit port 46 is connected to a second chamber 48 located in the second control 14 by conduit 47.

The chamber 18 is connected to the environment surrounding the first control 12 by an opening 50 in the housing 16.

A valve which includes a lever 52, with a cylindrical body 54 on a first end thereof, is attached to sidewall 22 by a low friction pivot pin 56 such as disclosed in U.S. Pat. Nos. 3,807,029 and 3,813,089. The cylindrical body 54 has a first face 58 and a second face 60 on the ends thereof. A bore 62 extends from the first face 58 to the second face 60. The pin 56 aligns the bore 62 with the entrance ports 30 and 30' in sidewalls 20 and 22, respectively.

First and second springs 63 and 64 extend from adjustment members 66 and 68, respectively into engagement with lever 50 to position bore 62 in axial alignment with the entrance ports 30 and 30'. Entrance port 30 is connected to a source of pressurized fluid. An end plug 70 prevents the pressurized fluid from flowing through port 30'. In addition faces 58 and 60 engage sidewalls 20 and 22, as best shown in FIG. 2, to seal the bore 62 from chamber 18. Thus in this neutral position, pressurized fluid is retained in bore 62. The force of the pressurized fluid acts on the cylindrical body equally and thus a balanced condition is present.

Projections 72 and 74 extend from the lever 52. These projections engage the housing 16 to limit the movement of the lever 52 on pin 56.

The second control 14 includes a housing 76 with a first inlet port 78 through which pressurized fluid is communicated to chamber 40 from conduit 42 and a second inlet port 80 through which pressurized fluid is communicated to chamber 48 from conduit 47. Chambers 40 and 48 are separated by a piston 82 which has stems 84 and 86 extending therefrom. Stems 84 and 86 which extend through the housing 76 are equal in size and thus the effective areas of piston 82 are balanced in both chambers 40 and 48. Stem 86 has a connector 88 on the end thereof to provide a device such as a bleed valve, flap actuator, etc. with movement.

MODE OF OPERATION OF THE INVENTION

An input force applied to end 53 of the lever 52 overcomes the centering force of springs 63 and 64 to allow the lever 52 to pivot on pin 56 and move cylindrical body 54 toward one of the operational ports and away from the other to open communications between the source of pressurized fluid and the second control 14.

For illustrative purposes, assume an input signal or force is applied to end 53 which causes lever 52 to pivot about pin 56 and move of cylindrical body 54 in an arcuate path to bring bore 62 into alignment with arcuate operational passages 32 and 32' to allow pressurized fluid to flow to chamber 40, by way of passages 36, 36', and 37, exit port 38, conduit 42 and port 78. At the same time bore 62 comes into alignment with arcuate operational ports 32 and 32', cylindrical body 54 uncovers arcuate operational ports 34 and 34' to allow free communication between chamber 48 and the surrounding environment by way of port 80, conduit 47, port 46, passages 43, 44 and 44', chamber 18 and exit port 50.

With pressurized fluid in chamber 40 and chamber 48 in communication with the surrounding environment, a pressure differential is created across piston 82. This pressure differential acts on piston 82 to develop a force that is transmitted through stem 86 to connector 88 for operating a device attached thereto. When the operation of the device is sufficient to meet the input signal, the input signal terminates and spring 63 acts on lever 52 to move the cylindrical body 54 to a neutral or null position between the operational ports 32, 32' and 34, 34'. In this position, the internal forces created by the pressurized fluid acting on the cylindrical body 54 are equal. Thus, lever 52 remains stationary until an input signal is again applied to end 53 of lever 52.

Thus, the first and second controls 12 and 14 operate together to amplify an input signal applied to the first control 12 sufficiently to operate a device attached to the second control 14.

I claim:

1. In a control member having a housing with a chamber therein, said housing having an entrance port connected to a source of pressurized fluid, first and second diametrically opposite arcuate operational ports concentric to said entrance port and connected to a fluid pressure responsive device, and an exit port for providing continual communication between the chamber and the environment surrounding the housing, and a valve located in the chamber for directing pressurized fluid from the entrance port to one of said first and second arcuate operational ports while allowing the other to be communicated to the chamber in response to an input signal, characterized in that said valve includes:

a lever arm having a first end and a second end, said first end having a cylindrical valve integral therewith, said cylindrical valve having a cylindrical bore therethrough that extends from a first face to a second face, said first and second faces engaging the housing; and a pivot pin extending through the lever arm to locate said cylindrical valve adjacent the entrance port and connect said bore with the pressurized fluid to define a flow path for the pressurized fluid in said chamber, said pressurized fluid in the bore acting on the lever to create a balanced force condition therein in the absence of an input signal, said cylindrical valve being moved in an arc by an input signal applied to said second end to connect said bore with one of said first and second arcuate operational ports and supply pressurized fluid to the pressure responsive device corresponding to the input signal.

2. In the control member, as recited in claim 1 wherein said valve further includes:

a first spring located between the housing and the lever; and a second spring located between the housing and the lever in the same plane as the first spring but on the opposite side of the lever, said first and second spring locating said lever in the housing to align said bore in the center of the entrance port in the absence of an input signal.

3. In the control member, as recited in claim 2 wherein said valve further includes:

an adjustment member connected to said first spring to initially position said lever in the housing such that the bore is in the center of said entrance port.

4. In the control member, as recited in claim 3 wherein said valve further includes:

a first projection extending from the lever for engaging the housing to limit the movement of the lever toward the first operational port; and a second projection extending from the lever for engaging the housing to limit the movement of the lever toward the second operational port.

5. A control member comprising:

a first housing having a first bore therethrough with an entrance port connected to a source of pressurized fluid and an exit port, a first passage with a first arcuate operational port located adjacent said exit port and a first distribution port connected to a pressure responsive device, a second passage with a second arcuate operational port located adjacent said exit port and a second distribution port connected to the pressure responsive device, said first and second arcuate operational ports being located in the same plane on diametrically opposite sides of said exit port;

a lever having an integrally formed cylindrical valve member on a first end; and a second end;

said cylindrical valve member having a second cylindrical bore that extends from a face on an end thereof; and a pivot pin for connecting said lever with the first housing to align the second bore with the first bore, said lever responding to an input signal applied to said second end by pivoting on said pin and moving the cylindrical valve member in an arc toward one of said first and second arcuate operational ports to allow pressurized fluid to flow to the pressure responsive device by way of the first and second bores and away from the pressure responsive device through the other of said first and second arcuate operational ports to allow free communication between the pressure responsive device and the surrounding environment, said pressurized fluid acting on the pressure responsive device in a manner corresponding to the input signal.

6. In the control member as recited in claim 5 further including:

resilient means connected to said first housing for urging the lever toward a null position wherein said second bore is maintained in axial alignment with the first bore in the absence of an input signal.

7. In the control member as recited in claim 6 further including:

adjustment means connected to said first housing for changing the position of said resilient means to assure that said second bore is aligned with the first bore.

8. In the control member as recited in claim 7 further including:

a second housing connected to the first housing and having a third passage connected to said first passage and a fourth passage connected to the second passage in the first housing, said third passage having a third operational port and said fourth passage having a fourth operational port, said third and fourth operational ports being aligned with the first and second operational ports, respectively, said second bore extending through the cylindrical member to provide a flow path for the pressurized fluid to one of the third and fourth operational ports on movement of said lever by the input signal to increase the volume of pressurized fluid supplied to the pressure responsive device on movement of the cylindrical member.

* * * * *